United States Patent [19]

Campbell

[11] Patent Number: 4,527,996

[45] Date of Patent: Jul. 9, 1985

[54] DEPOSIT CONTROL ADDITIVES - HYDROXY POLYETHER POLYAMINES

[75] Inventor: Curtis B. Campbell, Rodeo, Calif.

[73] Assignee: Chevron Research Company, San Francisco, Calif.

[21] Appl. No.: 687,064

[22] Filed: Dec. 28, 1984

Related U.S. Application Data

[63] Continuation-in-part of Ser. No. 547,559, Oct. 31, 1983, abandoned.

[51] Int. Cl.[3] ..... C10L 1/22

[52] U.S. Cl. ..... 44/72; 44/71; 44/77

[58] Field of Search ..... 44/63, 71, 77, 72; 564/505

[56] References Cited

U.S. PATENT DOCUMENTS

| | | | |
|---|---|---|---|
| 2,522,155 | 9/1950 | Ballard et al. | 252/51.5 |
| 3,231,619 | 1/1966 | Speranza | 564/505 |
| 3,440,029 | 4/1969 | Little et al. | 44/72 |
| 3,456,013 | 7/1969 | Egan et al. | 260/584 |
| 4,247,301 | 1/1981 | Honnen | 44/72 |
| 4,261,704 | 4/1981 | Langdon | 564/505 |
| 4,332,595 | 6/1982 | Herbstman et al. | 44/72 |

FOREIGN PATENT DOCUMENTS

| | | |
|---|---|---|
| 1484341 | 1/1975 | United Kingdom . |

*Primary Examiner*—Y. Harris-Smith

*Attorney, Agent, or Firm*—S. R. LaPaglia; J. M. Whitney; Q. T. Dickinson

[57] ABSTRACT

Additives for the control of deposits in the intake systems of engines are provided. The additives comprise hydroxy polyether amines of the general formula:

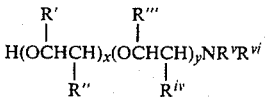

Also provided are a fuel composition containing from about 250 ppm to 5000 ppm of this additive and a concentrate containing this additive.

6 Claims, No Drawings

DEPOSIT CONTROL ADDITIVES - HYDROXY POLYETHER POLYAMINES

CROSS REFERENCE TO RELATED APPLICATIONS

This application is a continuation-in-part of pending application Ser. No. 547,559, filed on Oct. 31, 1983, now abandoned.

BACKGROUND OF THE INVENTION

1. Field of the Invention

Numerous deposit-forming substances are inherent in hydrocarbon fuels. These substances when used in internal combustion engines tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction, starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed by incorporating an active detergent into the fuel. These detergents function to cleanse these deposit-prone areas of the harmful deposits, thereby enhancing engine performance and longevity. There are numerous detergent-type gasoline additives currently available which, to varying degrees, perform these functions.

Two complicating factors have, however, recently arisen. First, with the advent of automobile engines that require the use of nonleaded gasolines (to prevent disablement of catalytic converters used to reduce emissions), it has been found difficult to provide gasoline of high enough octane to prevent knocking and the concomitant damage which it causes. The chief problem lies in the area of the degree of octane requirement increase, herein called "ORI", which is caused by deposits formed by the commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated in the same fuel for a prolonged period, will reach an equilibrium. This is apparently caused by an amount of deposits in the combustion chamber. Equilibrium is typically reached after 5000 to 15000 miles of automobile operation.

The octane requirement increase in particular engines used with commercial gasolines will vary at equilibrium from 5 or 6 octane units to as high as 12 or 15 units, depending upon the gasoline compositions, engine design and type of operation. The seriousness of the problem is thus apparent. A typical automobile with a research octane requirement of 85, when new, may after a few months of operation require 97 research octane gasoline for proper operation, and little unleaded gasoline of that octane is available. The ORI problem also exists in some degree with engines operated on leaded fuels. U.S. Pat. Nos. 3,144,311; 3,146,203; and 4,247,301 disclose lead-containing fuel compositions having reduced ORI properties.

The ORI problem is compounded by the fact that the most common method for increasing the octane rating of unleaded gasoline is to increase its aromatic content. This, however, eventually causes an even greater increase in the octane requirement. Moreover, some of presently used nitrogen-containing compounds used as deposit-control additives and their mineral oil or polymer carriers may also significantly contribute to ORI in engines using unleaded fuels.

It is, therefore, particularly desirable to provide deposit control additives which effectively control the deposits in intake systems of engines, without themselves eventually contributing to the problem.

The second complicating factor relates to oil solubility of the fuel additives. Fuel additives, due to their higher boiling point over gasoline itself, tend to accumulate on surfaces in the combustion chamber. This accumulation of the additive eventually finds its way into the lubricating oil via a "blow-by" process. In some cases this process may be of no concern as the fuel additives will be inert and compatible in the oil. However, if the additive is incompatible in the lubricating oil a serious problem develops as the accumulation of the additive results in an emulsion-like sludge which is detrimental to efficient operation. Therefore, it is particularly desirable that the gasoline additive be oil compatible.

2. Prior Art

Polyether amine-type fuel additives for deposit control are well-known but have traditionally been surfactant-type molecules having a large, non-polar hydrophobic end or "tail", for instance, a hydrocarbyl capped polyether moiety, and a polar, hydrophilic amine or polyamine end. Examples of these type of compositions may be found in U.S. Pat. Nos. 4,247,301; 4,160,648; and application U.S. Ser. No. 403,607, Campbell, filed July 7, 1982. In the present invention, however, a composition has been discovered which in gasoline fuel functions as a deposit control additive which has a single hydroxyl group in the non-polar hydrophobic portion of the molecule. These additives contain block copolymer polyethers in which there is no hydrocarbyl cap. Moreover, this additive is compatible in the lubricating oil.

DESCRIPTION OF THE INVENTION

Additives are provided which, when added to fuels or used as fuel concentrates, are effective in cleaning and maintaining the cleanliness of engine intake systems. The additives consist of certain fuel soluble hydroxy polyoxyalkylene amines or polyamines soluble in fuel boiling in the gasoline range. These additives have the following general formula:

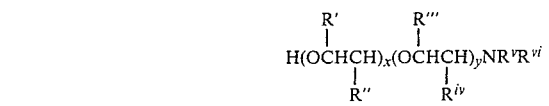

wherein:

R′ and R″ independently = H, or alkyl groups of 1 to 4 carbon atoms, and at least one of R′ and R″ has at least 2 carbon atoms;

R‴ and $R^{iv}$ independently = H or $CH_3$;

$R^{v}$ and $R^{vi}$ independently = H or $$(CH_2CH_2\overset{H}{N})_zH,$$

where

Z = 1 to 5 with the proviso that $R^{v}$ and $R^{vi}$ are both not hydrogen; and x and y independently are integers from 1 to 30.

The compositions may be either mono or polyamines, but polyamines are preferred. The additive compounds have molecular weights of from about 500 to 2000, and preferably from about 700 to 1200.

Among other things, this invention is based on my discovery that the hydrophobic portion of a polyether polyamine fuel additive may contain an "uncapped" hydroxyl group, provided that the polyether is a co-polymer and that the portion of the co-polymer having the hydroxyl group has more carbon atoms per unit than the other portion of the block co-polymer. Thus, a preferred compound is composed of a block co-polymer in which the hydroxyl-containing portion is composed of poly(butylene glycol) and the other portion is composed of poly(ethylene glycol). Furthermore, it is preferred that R′ has at least 2 carbon atoms, and that R″, R‴ and $R^{iv}$ are H.

As fuel additives, the compositions are selected to provide solubility in fuel compositions and deposit control activity without contributing to octane requirement increase (ORI).

In the fuel composition, the desired concentration of the additive will vary according to fuel type and quality and the presence or absence of other additives, etc. Generally, however, the concentration will be from about 250 parts per million (ppm) by weight to about 5000 ppm by weight. The preferred concentration is from about 300 ppm to 2000 ppm.

It is also contemplated that the additive compositions may be used as concentrates, and could be used as additive to fuels or lubricating oils subsequent to their preparation. In concentrates, the weight percent of these additives will usually range from about 0.3 to 50 weight percent. The concentrate would ordinarily comprise an inert stable olephilic organic solvent and the carrier of said solvent boiling in the range of from about 150° to 400° F. and the concentrate would preferably contain from about 10 to 50 weight percent of the additive compound.

The additive compounds can be prepared by a variety of known processes. In a preferred embodiment, an appropriate hydroxy-substituted amine, containing both the desired amino moiety and the appropriate hydroxy-terminated alkyl moiety, is reacted with an appropriate alkylene oxide or other oxylating agent. The resulting polyether amine is then reacted with a second epoxyalkane having the desired R′ or R″ brand alkyl groups, at least one of which has more than 2 carbon atoms. Upon termination of the second epoxidation, a block co-polymer is produced having a hydroxyl group near the end of the second polyether moiety.

In another embodiment, a halohydroxyalkylene, preferably chlorohydroxyalkylene is first reacted at the hydroxy terminus with an appropriate alkylene oxide. The halo group is then reacted with an amine or polyamine, preferably in excess to yield the hydroxy poly(oxyalkylene)amines or polyamines of this invention. Examples of suitable halohydroxyalkylenes include 2-chloroethanol, 2-chloropropanol, and the like.

The preparation of the compound is illustrated by, but not intended to be limited to, the following example for the preparation of

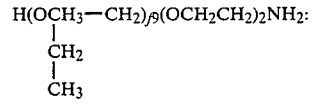

EXAMPLE

A solution of 10 ml (139 mmol) 2-(2-aminoethoxy)ethanol in 275 ml of dioxane was azeotropically dried by distilling off 25 ml in a nitrogen atmosphere. The solution was cooled to 0°–5° C. in an ice bath and approx. 6.5 gms (approx. 167 mmols) of potassium metal cut into small pieces was added with stirring while flushing the flask with nitrogen. After the addition was completed, the slurry was warmed to room temperature over 48 hours, and any unreacted potassium metal (approx. 1 gm, 26 mmols) was removed from the reaction.

The resulting slurry was heated to approx. 90° C. and 100 ml (1.16 moles) of distilled 1,2-epoxybutane was added over 30 minutes. After this addition, the reaction was stirred with heating for 30 minutes and then cooled to room temperature and stirred for 16 hours.

The reaction was quenched by adding approx. 200 ml of t-butanol and stirring 30 minutes, followed by approx. 50 ml of water. The reaction was diluted with 300 ml ether and extracted with two 100 ml portions of water.

Sufficient 10% aqueous HCl was added to the water extraction to bring the aqueous layer to about pH 7.

The product was washed with additional water, and the organic layer dried over anhydrous $K_2CO_3$. After filtration and concentration in vacuo, 98.2 gms (94% mass recovery) of a yellow oil was isolated: Basic N = 0.84%; MW = 759 ± 2; hydroxyl number = 125; and C = 65.76%, H = 11.31%, N = 0.85%.

By Carbon[13] NMR, no secondary amine was present indicating no polymerization at the amine nitrogen took place.

To test for deposit control activity, the hydroxy polyether amines prepared above were blended in gasoline to various concentrations and were run in the ASTM/CFR Single-Cylinder Engine Test.

In carrying out the tests, a Waukesha CFR single-cylinder engine is used. The run is carried out for 15 hours, at the end of which time the intake valve is removed, washed with hexane and weighed. The previously determined weight of the clean valve is subtracted from the weight of the valve. The difference between the two weights is the weight of the deposit with a lesser amount of deposit measured connoting a superior additive. The operating conditions of the test are as follows: water jacket temperature 100° C. (212° F.); manifold vacuum of 12 in Hg, intake mixture temperature of 50.2° C. (125° F.); air-fuel ratio of 12; ignition spark timing of 40°BTC; engine speed is 1800 rpm; and the crankcase oil is a commercial 30W oil. The amount of carbonaceous deposit in milligrams on the intake valves is measured and reported in the following Table I.

TABLE I

| | Average Washed Deposits (mg) | | | | |
|---|---|---|---|---|---|
| | Deposits (mg) | | | Deposits (mg) | |
| Run | Base Fuel | Base + 300 ppm additive | Run | Base Fuel | Base + 200 ppm additive |
| 1 | 101.3 | 0.0 | 4 | 118.7 | 241.8 |
| 2 | 96.1 | 87.1 | 5 | 176.3 | 3.5 |
| 3 | 121.0 | 1.4 | 6 | 70.1 | 364.1 |
| AVG | 106.1 | 29.5 | | 121.0 | 203.1 |

All specific embodiments of the invention have been described in detail. It should be understood that the invention is to be given the broadest possible interpretation within the terms of the following claims.

What is claimed is:

1. A fuel-soluble additive for engine deposit control having the formula:

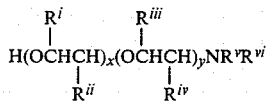

wherein $R^i$ and $R^{ii}$ independently are selected from the group consisting of hydrogen and alkyl groups having from 1 to 4 carbon atoms, and where at least one of $R^i$ and $R^{ii}$ has at least 2 carbon atoms; $R^{iii}$ and $R^{iv}$ independently are hydrogen or methyl; $R^v$ and $R^{vi}$ independently are hydrogen or $$(CH_2CH_2\overset{H}{N})_zH,$$

where Z is an integer from 1 to 5 with the proviso that $R^v$ and $R^{vi}$ both are not hydrogen; and x and y independently are integers from 1 to 30.

2. A deposit control additive as claimed in claim 1, wherein said additive has a molecular weight of from about 500 to about 2000.

3. A deposit control additive as claimed in claim 2, wherein said molecular weight is from about 700 to about 1200.

4. A concentrate comprising an inert stable olephilic organic solvent boiling in the range of 150° to 400° F. and from about 0.3 to about 50 weight percent of the compound of claim 1.

5. A fuel composition comprising a hydrocarbon fuel boiling in the gasoline range, and from about 250 parts per million by weight to about 5000 parts per million by weight of a fuel-soluble additive having the formula:

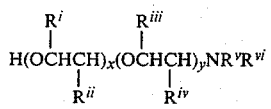

wherein $R^i$ and $R^{ii}$ independently are selected from the group consisting of hydrogen and alkyl groups having from 1 to 4 carbon atoms, and where at least one of $R^i$ and $R^{ii}$ has at least 2 carbon atoms; $R^{iii}$ and $R^{iv}$ independently are hydrogen or methyl's $R^v$ and $R^{vi}$ independently are hydrogen or $$(CH_2CH_2\overset{H}{N})_zH,$$

where Z is an integer from 1 to 5; and x and y independently are integers from 1 to 30.

6. A fuel composition as claimed in claim 5 wherein said concentration is from about 300 ppm by weight to about 2000 ppm by weight.

* * * * *